United States Patent [19]

Eiermann et al.

[11] Patent Number: 4,808,096

[45] Date of Patent: Feb. 28, 1989

[54] AXIAL SEALING SYSTEM OF A ROTARY PISTON ENGINE

[75] Inventors: Dankwart Eiermann, Weissensberg-West; Manfred Fischer, Lindau, both of Fed. Rep. of Germany

[73] Assignee: Wankel GmbH, Berlin, Fed. Rep. of Germany

[21] Appl. No.: 60,748

[22] Filed: Jun. 10, 1987

[30] Foreign Application Priority Data

Jun. 18, 1986 [DE] Fed. Rep. of Germany ..... 3620299

[51] Int. Cl.[4] ..... F01C 19/04; F01C 19/08

[52] U.S. Cl. ..... 418/113; 418/142; 277/81 P; 277/81 S; 277/192

[58] Field of Search ..... 418/113, 142; 277/81 P, 277/81 S, 81 R, 192

[56] References Cited

U.S. PATENT DOCUMENTS

| | | | |
|---|---|---|---|
| 3,674,384 | 7/1972 | Larrinaga et al. | 418/142 |
| 3,830,600 | 8/1974 | Shimoji et al. | 418/142 |
| 3,955,904 | 5/1976 | Catterson | 418/142 |
| 3,972,660 | 8/1976 | Mangus | 418/142 |

*Primary Examiner*—John J. Vrablik

*Attorney, Agent, or Firm*—Becker & Becker, Inc.

[57] ABSTRACT

An axial sealing system of a rotary piston engine with a triangular piston and a dual-arc casing runway surfacing with which a seal body arranged in axial groove or groove bore cooperating sealingly after each axial sealing strip at a preceding end thereof for sealing therewith and the preceding sealing plug under gas pressure from the working or operating chamber. The sealing body is a second sealing plug cut into by the sealing strip and the first sealing plug. Also this can be a sealing strip segment having a configuration that fits with respect to the cutout of the sealing strip and the first sealing plug.

5 Claims, 1 Drawing Sheet

AXIAL SEALING SYSTEM OF A ROTARY PISTON ENGINE

BACKGROUND OF THE INVENTION

1. Field of the Invention

The present invention relates to an axial sealing system of a rotary piston engine with dualarc casing raceway surfacing and a triangular piston rotating upon an eccentric of an eccentric shaft. The piston in grooves of corners thereof has axial sealing strips running against the casing runway surfacing and in arcuate-shaped grooves of side surfaces thereof has axial sealing strips, which sealingly cooperate with the radial sealing strips via sealing pins or bolts arranged in axial bores in the piston corners.

2. Description of the Prior Art

Via such an axial and radially effective sealing system there can be attained a complete sealing of the working or operating chambers to the outside and among each other. It is however known, that the axial sealing strips must be shorter by a section corresponding to distortions with consideration and with respect to the heat distortions thereof than the actual distance of the groove thereof from one sealing pin or bolt to the other. Via the effect of the rubbing or engagement thereof along the side wall of the housing there is noted that these sealing strips are pushed back in the groove thereof against the following sealing pin or bolt counter to piston rotational direction, so that between them and the preceding sealing bolt or pin there is opened a gap which results in a connection between the working or operating chamber and the inner space or chamber of the piston. This effect was considered as unavoidable or disregarded in view thereof that for sealing strips and pistons there were employed materials with substantially identical heat factor or coefficient. With greater difference of these values, most of all with generous tolerances there will result not only noticeable pressure losses in the working or operating chambers but rather most of all there will result a heating of the piston interior via penetration of hot gases, which can lead to a combustion or burning of the bearing- and transmission oil or lubricant and with that can lead to a destruction of the machine, when no oil or lubricant interior seal is provided as for example with compressors. Conversely burned or combusted gases or oil can be suctioned from the inner chamber of the piston into the working or operating chamber when an under pressure exists at this location.

SUMMARY OF THE INVENTION

An object of the present invention is to close a gap in the sealing system without thereby hindering or preventing functionally required capability of movement of the individually involved sealing elements. This object is fulfilled and resolved with the features of the present invention as described subsequently herein.

BRIEF DESCRIPTION OF THE DRAWING

This object, and other objects and advantages of the present invention, will appear more clearly from the following specification in conjunction with the accompanying drawing, in which.

DESCRIPTION OF PREFERRED EMBODIMENTS

Figure 1:
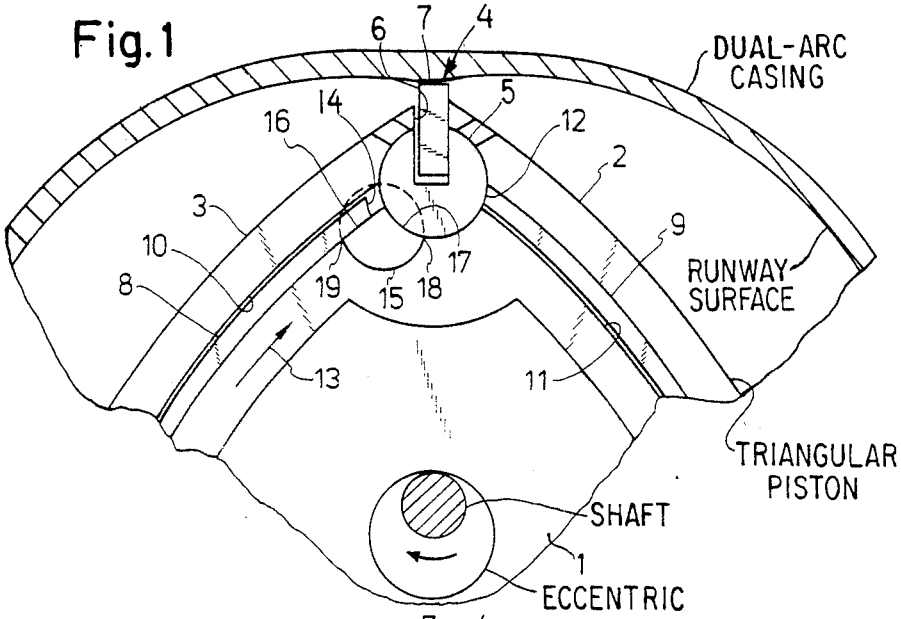
FIG. 1 is an axial partial view of a piston for a rotary piston engine having a sealing system with features according to the present invention.
Figure 2:
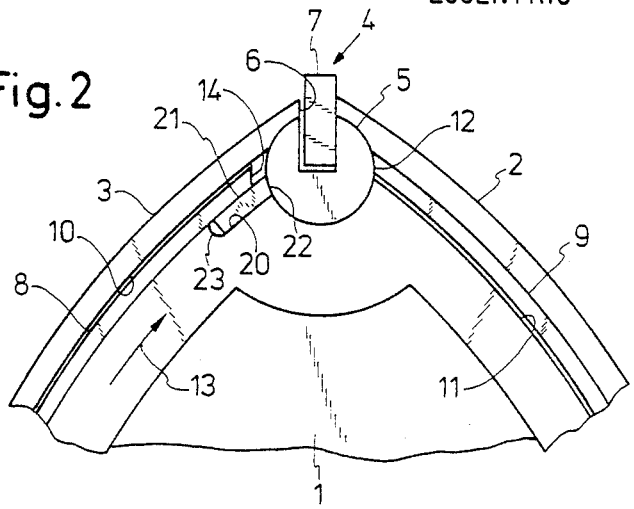
FIG. 2 is another axial partial view with a different embodiment of the features of the present invention for a sealing system.

Referring now to the drawing in detail, FIGS. 1 and 2 show only one corner of a triangular piston 1 of a rotary piston engine. Such piston having a preceding or advancing flank or side 2 and a following flank or side 3 thereof. A sealing pin, bolt or plug 5 is arranged in a corner 4 of the piston 1 and a radial sealing strip 7 is arranged in a radial groove 6 cut into the sealing pin, bolt or plug 5. Axial sealing strips 8 and 9 are provided in axial grooves 10 and 11 parallel as well as near or close to the flanks or sides 2 and 3 of the piston 1; a following end 12 of such sealing strip (only visible in the drawing illustration with the sealing strip 9) engages against the sealing pin, bolt or plug 5 under the gas pressure of the working or operating chamber. The sealing strips 8 and 9 are pushed away from the preceding sealing pin, bolt or plug 5 by friction against the housing side wall counter to rotational movement during rotation of the piston 1 in a direction of an arrow 13; and these sealing strips are pressed against a following sealing pin, bolt or plug 5 at the following end 12 by such pushing away and are pressed against the sealing pin, bolt or plug 5 at the following end 12 additionally by gas pressure in the chamber. A gap 14 in the sealing system results via this pushing or shifting back of the sealing strips. This gap 14 can be compensated, equalized or adjusted in operation with a corresponding heating of the sealing strip which however most of all is then not possible when the metal of the piston 1 has a higher heat coefficient or factor than the sealing strips.

A second sealing pin, bolt or plug 15 is provided and arranged in an axial bore after or behind the first sealing pin, bolt or plug 5 following in rotational direction. This sealing pin, bolt or plug 15 is seated with closer tight fit in the axial bore and is cut-into by the sealing pin, bolt or plug 5 in a sealing surface 16 by the sealing strip 8 and in a sealing surface 17 by the sealing pin, bolt or plug 5. The sealing strip 8 and the sealing pin, bolt or plug 5 are pressed against the second sealing pin, bolt or plug 15 with gas pressure from the working or operating chamber located before the flank or side 3 of the piston 1; this second sealing pin bolt or plug 15 with that is pressed sealingly against a groove wall thereof in a section between the points or locations 18 and 19, whereby gas pressure entering through the gap 14 is effective upon the second sealing pin, bolt or plug 15 in the same manner. The gap 14 in the sealing system is completely closed with that as described in the foregoing.

Production, fabrication and assembly are carried out in a useful and practical manner as follows: the groove bore for the second sealing pin, bolt or plug 15 is worked-out and finished for the placement or insertion of the second sealing pin, bolt or plug 15 in this groove bore prior to cutting or milling-out of the groove 10 an introduction of the groove bore for the first sealing pin, bolt or plug 5. In that case, the bore for the first sealing pin, bolt or plug 5 is effected first thereafter and the cutting or milling-out of the groove 10 occurs, whereby the cuts result in the sealing surfaces 16, 17 of the second sealing pin, bolt or plug 15.

In any case, at all times, respectively in accordance with the heat expansion coefficients or factors of the sealing strip and of the piston material there is noted that the second sealing pin, bolt or plug 15 can have a larger or smaller diameter, whereby the length of the engagement surface of the sealing strip 8 can be determined by the sealing surface 16 of the second sealing pin, bolt or plug 15.

In the further embodiment according to FIG. 2, a second groove 20 is provided adjoining radially directly behind the groove 10; the second groove 20 is provided with the same depth over a short piece of the sealing pin, bolt or plug 5 preceding this groove 20 in a direction counter to direction of rotation of the piston 1. A short segment 21 of a sealing strip is inserted in this groove 20 with a close or narrow fit and tolerance. This segment 21 is cut into by the sealing pin, bolt or plug 5 in the sealing surface 22. Another end 23 of the groove 20 cannot be longer than sealing strip segment 21 in order to be secured to assured against a shifting of the sealing pin, bolt or plug at the end 12 against the rotational direction of the piston 1 with the flank 2 by friction or rubbing against the housing side wall. The groove 20 is cut or produced in a useful and practical manner with a face cutter or miller in order to obtain a wall of an end 23 of the groove vertically or at right angles to the piston side surface. The sealing strip segment 21 is rounded-off in a useful and practical manner corresponding to a rounding of the end 23 of the groove 20.

The sealing strip segment 21 of the sealing strip 8 is pressed against the rearward wall of the groove 20 thereof during pressure application from the working or operating chamber located before the flank or side S of the piston 1; and a sealing surface 22 of the sealing strip segment 21 is pressed against the sealing pin, bolt or plug subject to cooperation of the gas pressure entering through the gap 14, whereby likewise also the sealing system is completely closed. The groove 20 together with the groove 10 can be cut or milled-out before introduction of the groove bore for the sealing pin, bolt or plug 5 for fabrication or production purposes and then the segment of one sealing strip is inserted in the groove 20 and is fastened or secured therein for example via a heat-soluble adhesive means and then afterwards the bore 15 for the sealing pin, bolt or plug 5 is undertaken, whereby the cut in the sealing surface 22 is produced.

A movement of the sealing strip piece or segment 21 counter to rotational direction of the piston 1 can be prevented also via other means, for example by insertion or installation of a pin, bolt or plug at 23.

A particular and special advantage is that independently of the problems of different heat expansion of the sealing strip means and of the piston, there need no longer be any attention directed as to the tolerances in the length of the sealing strips.

The present invention is, of course, in no way restricted to the specific disclosure of the specification and drawing, but also encompasses any modifications within the scope of the appended claims.

What we claim is:

1. An axial sealing system of a rotary piston engine with dual-arc casing runway surfacing and a triangular piston rotating upon an eccentric of an eccentric shaft, said piston having radial sealing strips that run along the casing runway surfacing and that are located in grooves of corners of the triangular piston as well as having axial sealing strips in arcuate shaped grooves in side surfaces of the piston, said axial sealing strips cooperating sealingly with the radial sealing strips via sealing plugs arranged in axial bores in the piston corners, the improvement therewith comprising:

a sealing body with sealing surfaces engaging in added sealing relationship complementary as to said sealing plug and positioned angularly radially inwardly of the respective piston corner at a location axially adjacent and parallel to the respective sealing plug as well as engaging against an axial sealing strip said sealing body being located radially of said axial sealing strip and being located laterally and angularly to one side in an axial groove means as to said sealing plug, said sealing body preceding said sealing plug in the rotational direction of the piston and following said axial sealing strip in said rotational direction.

2. An axial sealing system according to claim 1, wherein said sealing body is a second sealing plug arranged in an axial groove means with tight fit, said second sealing plug being cut into by the first sealing plug and the axial sealing strip in sealing surfaces thereof.

3. An axial sealing system according to claim 2, wherein a first bore for said first sealing plug is provided after milling-in of a groove for an axial sealing strip and a second bore for said second sealing plug is provided for installation of said second sealing plug.

4. An axial sealing system according to claim 1, wherein said sealing body is a segment of a sealing strip arranged with tight fit in a groove provided directly adjacent the groove of said axial sealing strip.

5. An axial sealing system according to claim 4, wherein a bore for said sealing plug is provided after milling-in of a groove for an axial sealing strip and a groove for said sealing strip segment is provided for installation of said sealing strip segment.

* * * * *